United States Patent [19]

Siegers

[11] 3,992,118

[45] Nov. 16, 1976

[54] SCAFFOLDING JOINT

[75] Inventor: Egidius Henrikus Gerardus Slegers, Helmond, Netherlands

[73] Assignee: SGB Group Limited, Surrey, England

[22] Filed: Oct. 9, 1974

[21] Appl. No.: 513,313

[30] Foreign Application Priority Data

Oct. 10, 1973 Netherlands ..... 7313914

[52] U.S. Cl. ..... 403/171; 403/175; 403/350; 403/374; 403/377; 182/179; 52/638

[51] Int. Cl.[2] ..... E04G 7/06

[58] Field of Search ..... 182/179, 178; 403/234, 403/237, 235, 351, 352, 175, 174, 178, 343, 374, 377, 263, 240, 242, 49; 52/638

[56] References Cited

UNITED STATES PATENTS

| | | | |
|---|---|---|---|
| 1,880,231 | 10/1932 | Bearly | 403/175 |
| 2,243,687 | 5/1941 | Sutherland | 403/175 |
| 2,463,006 | 3/1949 | Clute | 403/263 |
| 2,882,099 | 4/1959 | Symons | 182/179 |
| 3,613,832 | 10/1971 | Dunster | 182/179 |
| 3,835,612 | 9/1974 | Beziat | 182/178 |
| 3,885,648 | 5/1975 | Beziat | 52/638 |

FOREIGN PATENTS OR APPLICATIONS

| | | | |
|---|---|---|---|
| 199,421 | 9/1958 | Austria | 403/234 |
| 1,396,548 | 3/1965 | France | 182/179 |
| 1,261,335 | 4/1961 | France | 403/234 |
| 975,699 | 5/1962 | Germany | 403/374 |
| 93,130 | 1/1960 | Netherlands | 403/175 |

*Primary Examiner*—Reinaldo P. Machado
*Attorney, Agent, or Firm*—Burns, Doane, Swecker & Mathis

[57] ABSTRACT

A scaffolding connection between the ends of a plurality of horizontal members and an upright member, in which the end of each horizontal member is provided with oppositely directed tongues projecting laterally therefrom, and the upright member has thereon opposed retaining elements adapted to receive said tongues, one retaining element being fixed to the upright member and the other retaining element being movable along the upright member with respect to said fixed element, the arrangement being such that after separation of the retaining elements, one projecting tongue on each horizontal member can be engaged in the fixed retaining element and the oppositely directed projecting tongues engaged in and by the movable retaining element, thereby locating the ends of the horizontal members in relation to the upright member, the latter also having thereon means for engaging the movable retaining element to clamp it against movement away from the fixed retaining element after the said projecting tongues have been engaged in and by the movable retaining element.

13 Claims, 6 Drawing Figures

SCAFFOLDING JOINT

BACKGROUND OF INVENTION

This invention relates to scaffolding and it has for its object the provision of an improved connection between a number of horizontal tubular members and an upright member.

SUMMARY OF INVENTION

To this end according to this invention there is provided a scaffolding connection between the ends of a plurality of horizontal members and an upright member, in which the end of each horizontal member is provided with oppositely directed tongues projecting laterally therefrom, and the upright member has thereon opposed retaining elements adapted to receive said tongues, one retaining element being fixed to the upright member and the other retaining element being movable along the upright member with respect to said fixed element, the arrangement being such that after separation of the retaining elements, one projecting tongue on each horizontal member can be engaged in the fixed retaining element and the oppositely directed projecting tongues engaged in and by the movable retaining element, thereby locating the ends of the horizontal members in relation to the upright member, the latter also having thereon means for engaging the movable retaining element to clamp it against movement away from the fixed retaining element after the said projecting tongues have been engaged in and by the movable retaining element.

Preferred features of this invention will be apparent from the following particular description and the appended claims.

DESCRIPTION OF PREFERRED EMBODIMENTS

Figure 1:
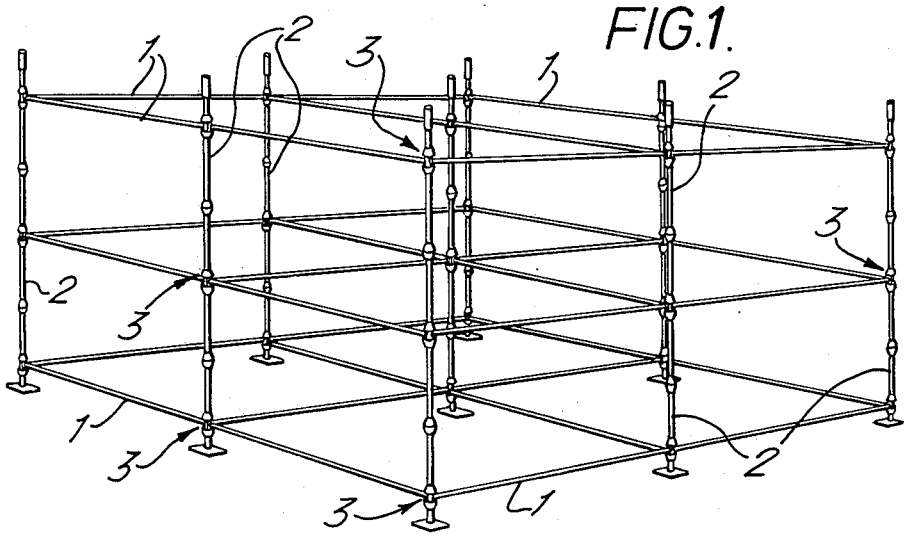
FIG. 1 shows a scaffolding incorporating connections in accordance with this invention.
Figure 2:
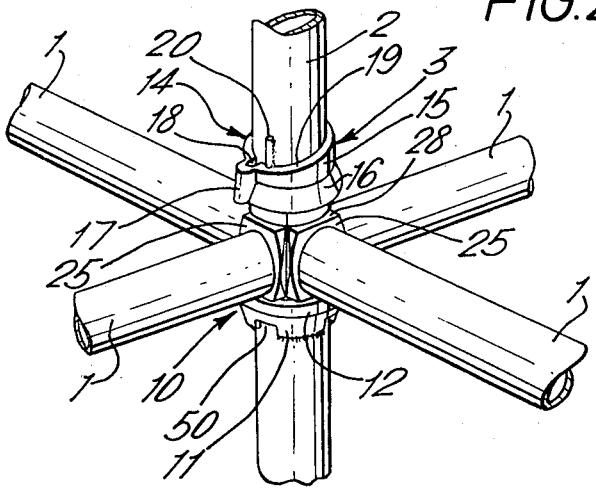
FIG. 2 shows, on an enlarged scale, a single connection, that is between four horizontal members and an upright member.
Figure 3:
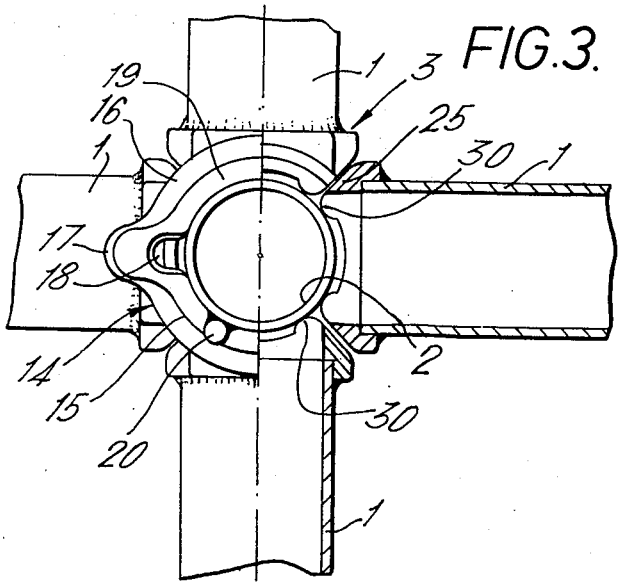
FIG. 3 is a part-plan part-sectional view, drawn on a still larger scale, of the connection shown in FIG. 2.
Figure 4:
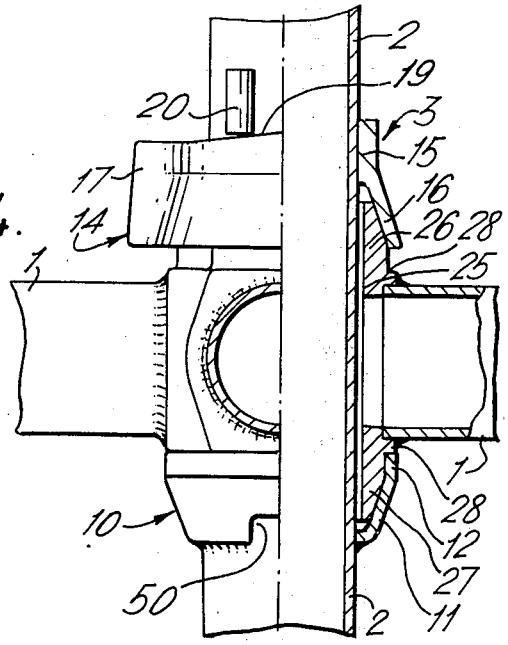
FIG. 4 is a part-side elevation part-sectional view, drawn on the same scale as FIG. 3, of the connection shown in FIG. 2.
Figure 5:
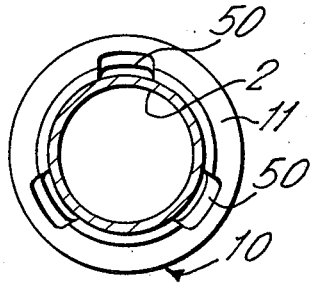
FIG. 5 is an underneath plan view of the lower part of the connection as shown in FIGS. 3 and 4, the upright member being shown in section.

FIG. 1 shows a supporting scaffolding made up from members of standard form, that is horizontal members 1 and upright members 2, and incorporating connections 3 in accordance with this invention. As shown, an upright member 2 can be connected to two, three or four horizontal members 1.

A single connection, see FIGS. 2 to 5, comprises, at its lower end, a retaining element in the form of a bush or cup-like member 10 which is welded to an upright member 2 so as to define an annular channel around it, such channel being open at its upper end. The lower part 11 of the wall of the bush is inclined upwardly and outwardly from the upright member and terminates in a short upper part 12 of cylindrical form.

The connection also comprises, at its upper end, a retaining element in the form of a clamping bush or cup-like member 14 which is slidably mounted on the upright member 2 and also defines a channel around it, the channel in this case, however, being open at its lower end, the wall of the clamping bush having a cylindrical upper part 15 which fits closely around the upright member and a downwardly and outwardly inclined lower part 16. At one side, the clamping bush 14 has a projection 17 in which there is formed, adjacent the upright member 2, a vertical slot 18. The top face 19 of the clamping bush 14 may be inclined upwardly from either side of the projection 17, as shown, or continuously for a full 360° from one side, thus forming a wedge-shaped surface.

The upright member 2 has on the side thereof an integral lug 20 which is of such size that it can pass through the slot 18 in the projection 17 on the clamping bush. Thus, if the clamping bush is turned to bring the lug 20 into line with the slot 18, then the clamping bush can be moved up and down the upright member 2 past the lug.

A horizontal member 1 is welded at each end into an apertured plate 25 provided with upwardly and downwardly directed tongues 26 and 27 respectively, the form of these tongues being described in detail hereinafter. The plate 25 is formed at its upper and lower ends with flattened shoulders 28.

When it is desired to form a connection between, for example, four horizontal members 1 and an upright member 2, the clamping bush 14 is first turned so that it can be moved up past the lug 20. If it is then turned to move the slot 18 in the projection 17 out of line with the lug 20, then the clamping bush can be rested on the lug. Tongues 27 on the plates 25 on the ends of the four horizontal members can now be inserted in the channel defined by the bush 10 on the upright member 2. The tongues 27 are formed so that they fit into the bush 10, that is to say each tongue has a tapered lower part and a short cylindrical upper part. When a tongue 27 has been fitted into the bush 10 the shoulder 28 above it rests on the top face of the bush.

Each end plate 25 defines a quarter of a cylinder so that when the tongues on the end plates on the four horizontal members 1 have been inserted into the bush 10 they fit tightly together around the upright member 2. However, the end plates 25 may be provided with protuberances 30 which actually abut the upright member 2. This allows for dirt or rust which may be present, and also for any tolerance differences.

The clamping bush 14 is now turned back until the slot 18 in the projection 17 is in line with the lug 20, is dropped past the lug and turned again so that the lug 20 now engages the inclined top face 19 of the clamping bush. By hammering on the projection 17, the clamping bush can be wedged tightly under the lug 20. The tongues 26 on the end plates 25 are generally similar in form to the tongues 27, that is to say they have tapered outer (upper)parts, and these parts wedge tightly in the lower part 16 of the clamping bush.

When a connection has been completed the four horizontal members are fixedly located at right angles to each other.

When it is desired to dismantle a connection, the reverse procedure is followed. Due to the provision of the shoulders 28 on the plates 25 the tongues 27 do not become wedged or jammed in the bush 10, and the horizontal members 1 can be lifted clear without difficulty or the need for any hammering.

A scaffolding incorporating connections as above described is very stable and the use of diagonal struts or braces is usually unnecessary. Since the horizontal members 1 are clamped fast at the connections, more particularly in the vertical direction, they can take a considerable load and swaying is obviated. The horizontal members 1 with their end plates and the vertical members 2 with the fixed and clamping bushes thereon are all simple to manufacture and enable rapid assembly and dismantling to be carried out. Individual horizontal members can readily be interchanged and replaced. A connection has few relatively moving parts so that water is minimised. A projection 17 provides a single and easily accessibly striking surface. There are no obstructively projecting or loose parts, even after dismantling, so that storage is facilitated.

Instead of using four horizontal members 1, less than four can be used in which case the members can be arranged at any desired angle with respect to each other.

Figure 6:
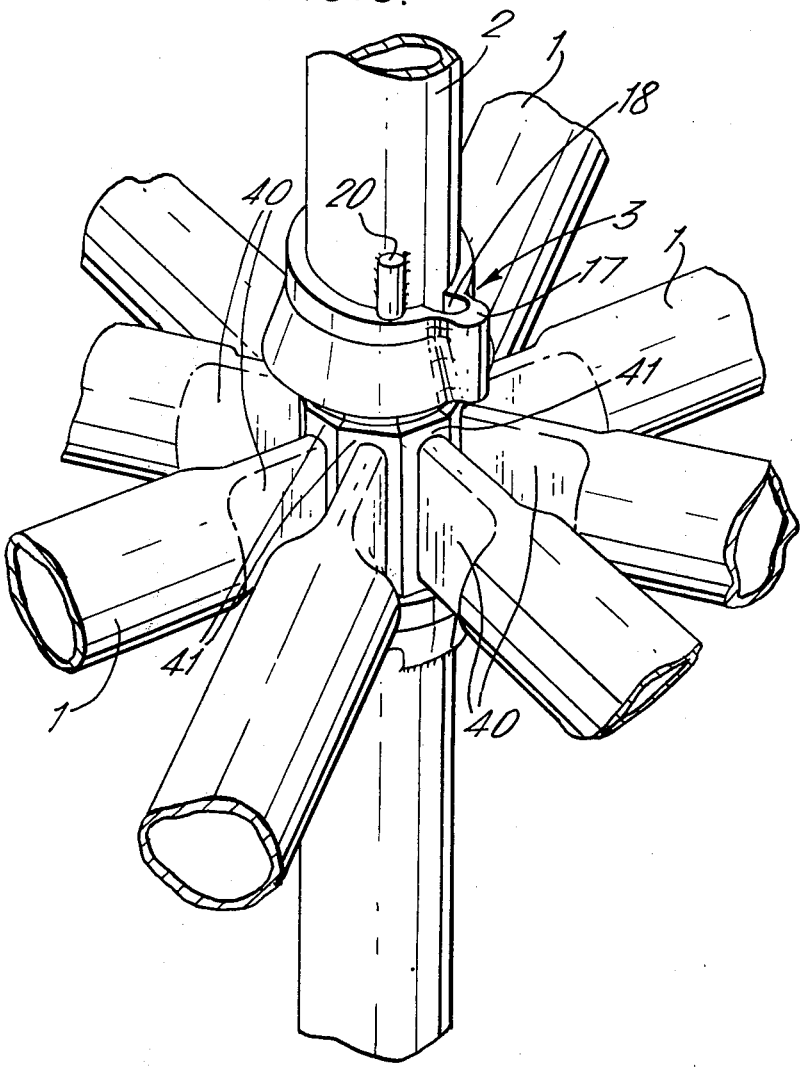
FIG. 6 shows a modified connection, that is between eight horizontal members and an upright member.

It is also possible for more than four horizontal members to be joined in a single connection and an example of this is shown in FIG. 6. The ends of the horizontal members would need to be flattened, as shown at 40 and end plates 41 connected thereto are made smaller so that, for example, eight fit together around an upright member 1 (as shown).

The fixed bush 10 is preferably formed (see FIG. 5) with one or more apertures 50 along its bottom edge to allow for the escape of water and dirt.

I claim:

1. A scaffolding connection between the ends of a plurality of horizontal members and an upright member, in which the end of each horizontal member is provided with oppositely directed tongues projecting laterally therefrom, and the upright member has thereon opposed retaining elements adapted to receive said tongues, one retaining element being fixed to the upright member and the other retaining element being movable along the upright member with respect to said fixed element, the arrangement being such that after separation of the retaining elements, one projecting tongue on each horizontal member can be engaged in the fixed retaining element and the oppositely directed projecting tongues engaged in and by the movable retaining element, thereby locating the ends of the horizontal members in relation to the upright member, the latter also having thereon means for engaging the movable retaining element to clamp it against movement away from the fixed retaining element after the said projecting tongues have been engaged in and by the movable retaining element.

2. A scaffolding connection as claimed in claim 1 wherein the retaining elements comprise two bushes which define opposed annular channels around the upright member for the reception of the tongues on the horizontal members.

3. A scaffolding connection as claimed in claim 2 wherein the fixed bush is welded to the upright member and defines a channel around it which is open at its upper end, and the movable bush is slidably and rotatably mounted on the upright member above the fixed bush and defines a channel around the upright member which is open at its lower end.

4. A scaffolding connection as claimed in claim 3 wherein the upright member is provided on the side thereof above the fixed bush with an integral lug, and the movable bush has a projection in which there is formed a slot through which said lug can pass, and the top face of the movable bush is inclined upwardly from said projection to form a wedge-shaped surface, the arrangement being such that when the lug is in line with the slot the movable bush can be moved freely up and down the upright member past the lug, but when the movable bush is moved below the lug and is then rotated the inclined top face of the movable bush engages and wedges beneath the lug, the movable bush thus becoming clamped against movement along the upright member away from the fixed bush.

5. A scaffolding connection as claimed in claim 4 wherein the movable bush includes a cylindrical upper part which fits closely around the upright member and a lower part which is inclined downwardly and outwardly from said upper part.

6. A scaffolding connection as claimed in claim 5 wherein the fixed bush has a lower part which is inclined upwardly and outwardly from the upright member and terminates in an upper part of cylindrical form.

7. A scaffolding connection as claimed in claim 6 wherein the end of each horizontal member is welded into an apertured plate on which the oppositely directed tongues are provided, the plate being formed at its upper and lower ends with flattened shoulders, it being so arranged that when one of the tongues is engaged in the fixed bush, the shoulder above it rests on the top face of the bush.

8. A scaffolding connection as claimed in claim 7 wherein the end plates each form part of a cylinder so that they fit tightly together around the upright member.

9. A scaffolding connection as claimed in claim 7 including four horizontal members, the end plates thereon each defining a quarter of a cylinder, so that when the tongues thereon have been inserted in the fixed bush and clamped by the movable bush the plates fit tightly together around the upright member.

10. A scaffolding connection as claimed in claim 9 in which the end plates are provided with protuberances which actually abut the upright member.

11. A scaffolding connection as claimed in claim 10 in which the ends of the horizontal members are flattened.

12. A scaffolding connection as claimed in claim 11 wherein the fixed bush is formed with apertures along its bottom edge to allow for the escape of dirt and water.

13. A scaffold structure comprising (a) a plurality of elongated upright members; (b) at least one pair of cup-like members along the length of each of said upright members, the lower of the cup-like members of a pair being fixed to the upright member and forming therewith an upward-opening annular space, the upper of the cup-like members of a pair being slidable on and forming with the upright member a downward-opening annular space, said upper cup-like member being provided with an axially extending slot of sufficient depth to clear a protrusion on the upright member and permit sliding thereover, said upper cup-like member having a sloping upper surface engagable with said protrusion; (c) a plurality of elongated horizontal members; (d) a pair of lateral, oppositely extending tongues at the ends of each of said horizontal members insertable into the annular space formed by the cup-like members with said upright members, whereby upon insertion of one tongue of a pair into the fixed cup-like member, a horizontal member is rigidly secured to an upright member by sliding the upper cup-like member over the second tongue of the pair and rotating said upper cup-like member to engage the sloping upper surface thereof with the protrusion on the upright member to force said upper cup-like member into tight engagement with said second tongue.

* * * * *